US006425258B1

(12) United States Patent
Barnett et al.

(10) Patent No.: US 6,425,258 B1
(45) Date of Patent: Jul. 30, 2002

(54) ICE GUIDE FOR AN ICE MAKING MACHINE

(75) Inventors: Mark Barnett, Sharpsburg; Glenn O'Neal Melton, Fayetteville; Kazuhiro Yoshida, Peachtree City, all of GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 09/731,714

(22) Filed: Dec. 8, 2000

(51) Int. Cl.[7] ..... F25C 5/18
(52) U.S. Cl. ..... 62/344
(58) Field of Search ..... 62/344, 347

(56) References Cited

U.S. PATENT DOCUMENTS

| | | | | |
|---|---|---|---|---|
| 2,693,275 | A | | 10/1954 | Andrews |
| 3,913,349 | A | | 10/1975 | Johnson |
| 4,341,087 | A | | 7/1982 | Vansteenburgh, Jr. |
| 4,363,220 | A | | 12/1982 | Ripley |
| 4,366,679 | A | | 1/1983 | Vansteenburgh, Jr. |
| 4,459,824 | A | | 7/1984 | Krueger |
| 4,589,261 | A | | 5/1986 | Ohashi et al. |
| 4,706,466 | A | | 11/1987 | Yingst et al. |
| 4,722,199 | A | | 2/1988 | Hibino |
| 4,893,478 | A | | 1/1990 | Kruck et al. |
| 4,917,256 | A | | 4/1990 | Kruck et al. |
| 4,920,764 | A | | 5/1990 | Martin |
| 5,182,925 | A | | 2/1993 | Alvarez et al. |
| 5,237,837 | A | | 8/1993 | Naruse et al. |
| 5,291,752 | A | | 3/1994 | Alvarez et al. |
| 5,345,782 | A | | 9/1994 | Takahashi et al. |
| 5,426,954 | A | * | 6/1995 | Furukawa ..... 62/347 |
| 5,722,244 | A | | 3/1998 | Shelton |
| 5,803,561 | A | | 9/1998 | Puehlhorn |
| 5,878,583 | A | | 3/1999 | Schlosser et al. |
| 6,112,533 | A | | 9/2000 | Kato et al. |
| 6,122,927 | A | | 9/2000 | Moore |

* cited by examiner

*Primary Examiner*—William E. Tapolcai
(74) *Attorney, Agent, or Firm*—Arent Fox Kintner Plotkin & Kahn, PLLC

(57) ABSTRACT

An ice guide that snap fits into a water tank of an ice making section of an ice manufacturing machine. The ice guide includes a lattice structure having a pair of substantially parallel first sides and substantially parallel second sides that are perpendicular to the first sides. The lattice structure defines an aperture in a center thereof and has a plurality of rows radiating from the center in an arcuate manner. Each row includes a plurality of spaced rails with each rail having a longitudinal axis directed toward the aperture. Also, a band bounds the rows, wherein the band at each of the first and second sides is positioned at a non-planar altitude higher relative to a horizontal plane passing through the center of the aperture to form a slope along which the dropped ice slides as the ice is directed into a storage bin below.

4 Claims, 9 Drawing Sheets

ICE GUIDE FOR AN ICE MAKING MACHINE

BACKGROUND OF THE INVENTION

1. Field of the Invention

This invention relates to an ice guide designed to improve the flow of ice into a storage bin and flow of water through the ice guide into a water tank positioned beneath the guide to prevent ice from collecting thereon.

2. Description of Related Art

It is well known in the art that there are essentially two types of ice making machines, household units and self-contained commercial units. The household units are typically combined with refrigerators commonly located in the kitchen of a house or office. The household units manufacture relatively small batches of ice by using cool air to freeze water in a tray located in the freezer section of the refrigerator.

The self-contained commercial units are most frequently used in hotels, restaurants, taverns, hospitals, as well as any other establishment regularly requiring relatively large batches of ice to be provided for customers. It should be noted the self-contained commercial units can be further separated into one of two categories depending upon the type of ice they manufacture, namely flaked and cubed. The self-contained commercial units can manufacture ice in several well known ways.

For example, a steady stream of water is either circulated over or dripped onto a chilled ice mold, which deposits several thin layers of ice in pockets of the mold, resulting in ice cubes. Other self-contained commercial units circulate the steady stream of water over ice making plates. The plates can be flat, grid-shaped, or any other configuration necessary to accommodate the specific shape desired. Evaporator tubes are attached to the back of the ice making plates to change the flowing water to ice via heat exchange. The ice making plates are known to be designed to have single or dual-sided rows of ice.

Water that does not freeze after being circulated over the chilled ice mold or ice making plates is collected in a water tank located beneath the ice making assembly. The collected water is recirculated over the chilled mold or ice making plates until the water is cool enough to freeze. Normally, the making machine is designed to stop ice production when the formed ice has reached a predetermined size. Then, when the ice making machine has determined that the chilled ice mold or ice making plate is substantially full of ice, the formed ice is harvested from the mold or plates. The harvested ice is typically stored in an insulated but unrefrigerated bin. The bin is insulated to keep the ice cool but is unrefrigerated so the ice may melt slowly, thereby preventing the ice from sticking together.

The ice making mold or plates are chilled because of their proximity to the evaporator of a standard refrigeration circuit. Typically, refrigerant gas is compressed within closed tubes of a refrigeration circuit. A compressor, driven by an electric motor, compresses the refrigerant to a high pressure and supplies the compressed refrigerant to a condenser. The condenser then cools the compressed refrigerant using air or water blown across tubes by a fan.

The compressed refrigerant is then passed through an expansion valve, which considerably drops the pressure of the refrigerant, thereby cooling the refrigerant. Tubes holding the expanded, cooled refrigerant are attached, usually by welding, to the back of an evaporator plate. The evaporator plate is typically made of copper and is attached to a lattice-like structure of evaporator tubes, also made of copper, used to mold the ice into cubes. The lattice-like structure and evaporator plate form the mold or plate and, together with the copper tubing, are known as the evaporator.

The ice is harvested by passing hot compressed air into the evaporator so the ice mold or plate is warmed and the ice slightly thaws. Typically, the mold or plate is positioned so gravity pulls the semi-thawed ice off the mold or plate and into the ice storage bin. The storage bin includes an ice level sensor so the ice making machine halts ice production if the bin is storing a predetermined amount of ice.

An electronic controller, such as for example only, a microprocessor, controls the process to activate the operating parts like the fans, motors, pumps, and valves that control the functioning of the ice maker. The ice level sensor provided in the storage bin is also controlled by the microprocessor.

Commercial self-contained ice makers are required to continuously and reliably produce relatively large amounts of ice. Furthermore, since the self-contained ice makers are primarily used in the service industries, i.e., hotels, restaurants, and the like, when an ice maker breaks down or produces an insufficient amount of ice, service is disrupted. However, because ice is a fungible good and provides very little if any profit, users typically do not seek better ice, but rather less costly ice made from a reliable and cost efficient ice maker that is easy to assemble and maintain.

Accordingly, low-cost operation requires an ice maker be nearly maintenance-free because down-time for maintenance costs money as someone must be paid to service the machine. Furthermore, such low-cost operation and maintenance must extend over many years, as ice makers are relied upon to manufacture ice over a long period of time.

Another problem faced by many ice making machines is corrosion. Because ice making machine housings are typically made of metal, corrosion occurs from the water splashing about the interior of the machine due to the water dripping onto the mold, as well as when ice is released for harvesting. Also, manufacturing an ice making machine having a structure that deals with the splashing water without leaking usually involves seals having various types of fasteners to make the machine water-tight. Therefore, because there is a large number of parts needed to provide a watertight seal, assembling such ice making machines is generally complicated.

Yet another problem ice making machines face is the difficulty of servicing and maintenance. Preferably, the refrigeration components and the control electronics should be isolated from the splashing water and humidity of the ice maker, yet still allow easy access for repair. In other words, ice making machines must be able to insulate the cold areas and wet areas from the dry and warm areas.

In particular, the ice making section has to accommodate water circulation, ice molds or ice making plates, water tanks, pumps, and evaporators. To be efficient, the ice making section must also be water-tight, insulated, and simple to clean and maintain. Some existing designs have roto-molded sections made for the entire ice making section. Although this design meets the above-described design criteria, there is the drawback that there must be a specific mold for each size ice making machine, which increases factory time and manufacturing costs.

Furthermore, it should be noted that the water tank is not only used to store water in the ice machine, but also acts as a level guide for ice inlet and as a checkpoint for ice production. Some existing water tank designs also have level switches to gauge when to turn the water valve on and off based on the level of the water therein. However, because of the additional components needed to provide these other functions, the water tanks are very difficult to clean and maintain when trying to remove build-up of scale, lime, or other such residue that results from the water being circulated therethrough.

Ice guides move the formed ice along a predetermined path from the ice making plate to the ice storage bin. The ice guide must withstand the dropping force of the ice as well as permit the splashing and dripped water to flow to the water tank below so as to be recirculated. Some known ice guide designs provide a chute that directs the water into a small tank to be pumped. Other ice guide designs also have the chute going to a particular area. Yet even other ice guides are attached to the evaporator, making it difficult to detach, clean, repair and otherwise maintain the guide. Furthermore, the ice guide should be designed so none of the manufactured ice becomes stuck, which can lead to bridging and malfunction of the ice making machine, thereby necessitating maintenance if not repair costs.

SUMMARY OF THE INVENTION

Accordingly, it is an object of this invention is to provide an ice guide for an ice making machine that overcomes the above-described deficiencies of the related art.

Another object of this invention is to simplify the design for the ice guide so as to allow for the concurrent use of multiple evaporator plates wherein each evaporator plate leads to a common drop chute. The ice guide of this invention directs the formed ice into the drop chute and the storage bin below as well as prevents the ice from falling into the water tank beneath the ice guide. The ice guide has a symmetric lattice type structure positioned beneath all of the evaporator plates within the ice making machine such that no ice can escape being directed into the drop chute.

Yet another object of this invention is to provide an ice guide that can be snugly fit into a water tank such that any ice particles that break off the formed ice dropping onto the ice guide and any water dripping off of the evaporator plates can pass directly and smoothly through the ice guide and into the water tank. The snug fitting design of the ice guide into the water tank will allow for a stiffer and more rigid ice guide that will be more durable.

The ice guide can be a single part or comprise multiple interlocking parts. The design of the ice guide is such that the guide can be manufactured to be any size and is not limited to a particular sized ice making machine.

BRIEF DESCRIPTION OF THE DRAWINGS

These and other objects and advantages of this invention will become more fully apparent from the following detailed description when read in conjunction with the accompanying drawings with like reference numerals indicating corresponding parts throughout, wherein.

DETAILED DESCRIPTION OF THE PREFERRED EMBODIMENT

Figure 1:
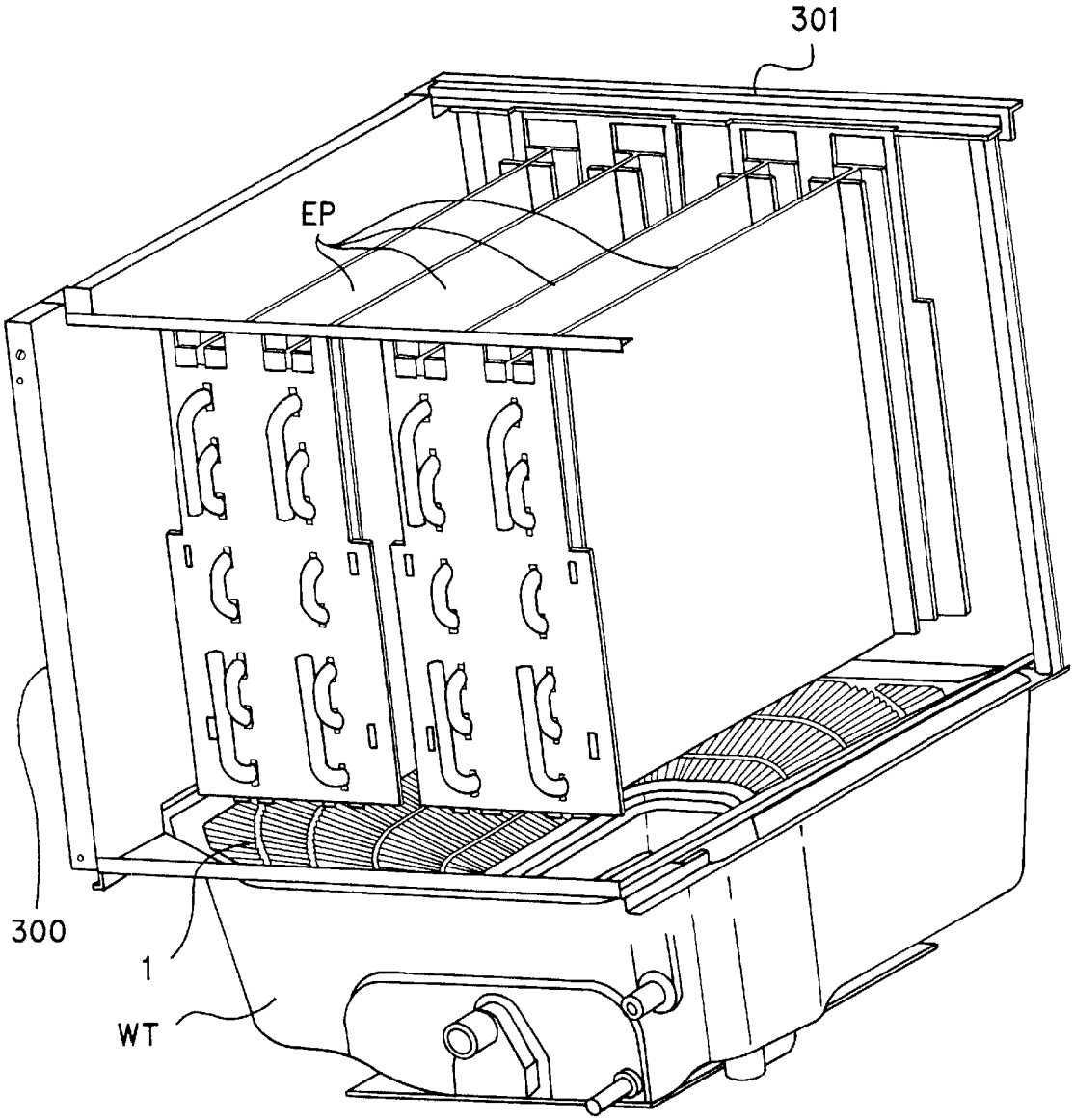
FIG. 1 is a perspective view of the ice guide according to the preferred embodiment of this invention arranged to be snug fit within a water tank provide in the ice making section of an ice making machine.

FIG. 1 illustrates a perspective view of a water tank WT arranged within the ice making section of an ice making machine according to the preferred embodiment of this invention. The water tank WT is positioned beneath an ice guide 1 within the ice making section of the ice making machine (not shown). The water tank WT and ice guide 1 are both located above an ice bin 100 (See FIG. 2) where the harvested ice I is directed and the dashed 200 indicates a pile of the harvested ice.

Figure 2:
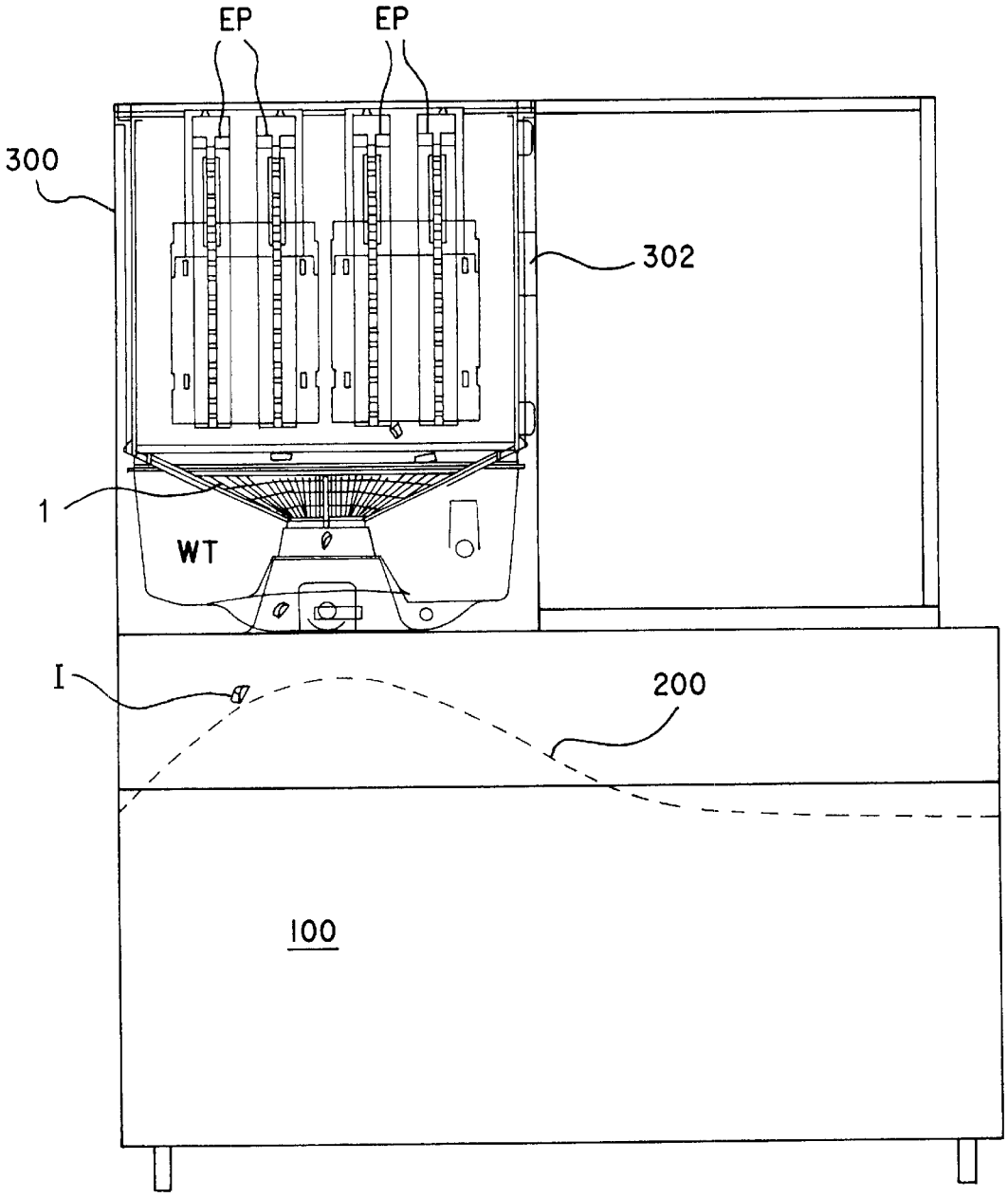
FIG. 2 is a schematic diagram of the arrangement of FIG. 1 positioned above an ice bin.

The water tank WT and ice guide 1 are disposed beneath at least one evaporator plate EP, FIGS. 1–2 providing four evaporator plates EP merely as an example. The evaporator plates EP are positioned above the ice guide 1 and water tank WT so that when the ice I is harvested in a conventional manner, the ice I falls off the evaporator plates EP and drops onto the ice guide 1, from where the ice I is guided into the bin 100.

Figure 3:
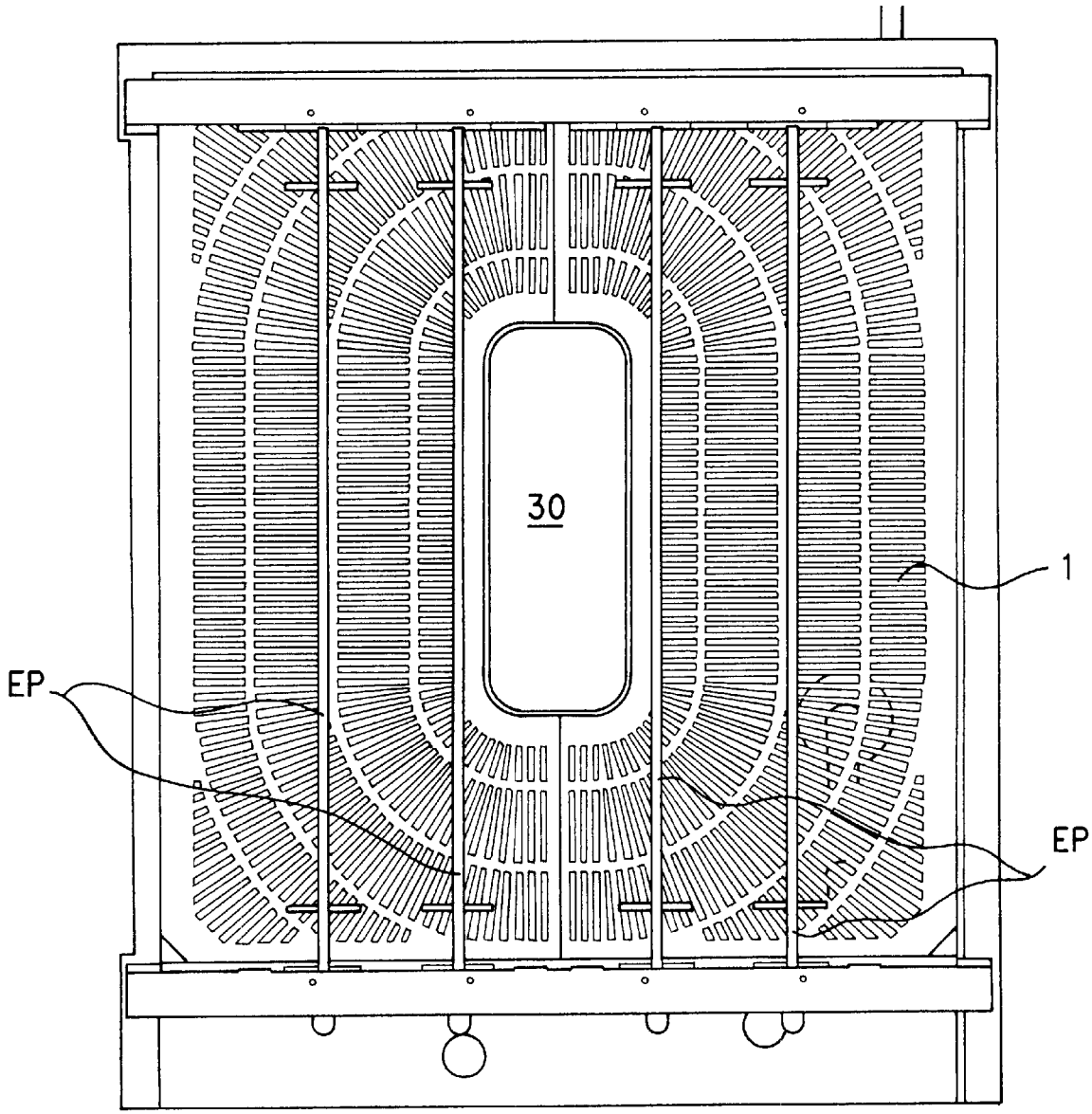
FIG. 3 is an overhead view of the arrangement in FIG. 1.

FIG. 3 is an overhead view of the assembly shown in FIG. 1. As can be seen, the four evaporator plates EP are positioned directly above the ice guide 1, which is snugly fit in the water tank WT. Accordingly, when the ice I is harvested from the evaporator plates EP, the falling ice I is directed by the ice guide 1 into a rectangular aperture 30 defined by the water tank WT which communicates with the ice bin 100 below.

Figure 4:
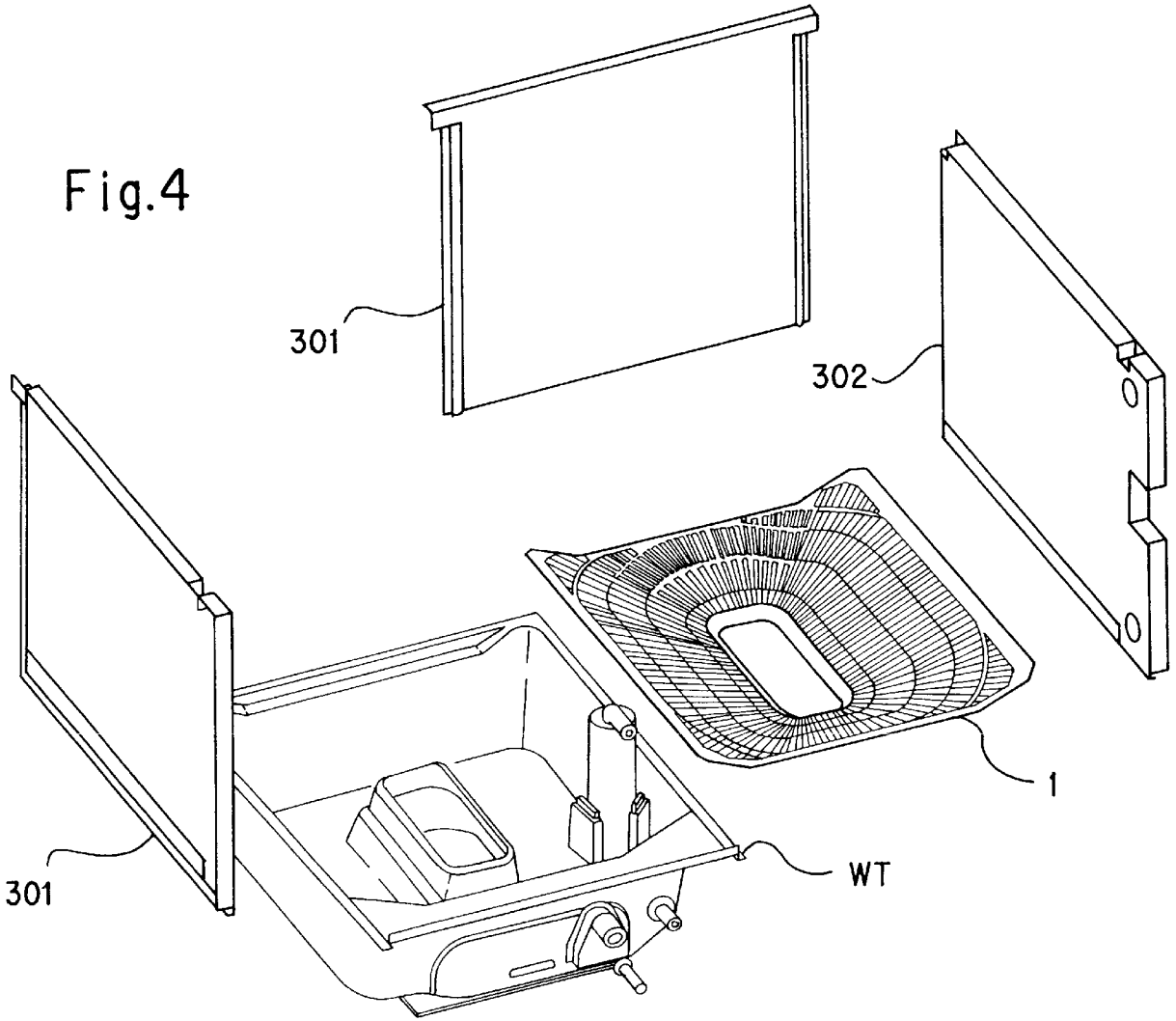
FIG. 4 is an exploded view of the arrangement of FIG. 1 without evaporator plates.

FIG. 4 is an exploded view of the arrangement shown in FIG. 1 with the evaporator plates EP not shown to simplify explanation. As can be seen, the ice guide 1 is designed to snugly fit within the water tank WT. The snug fit assembly of the ice guide 1 and water tank WT is bound by the walls, 300, 301, and 302 of the ice making machine.

Figure 5:
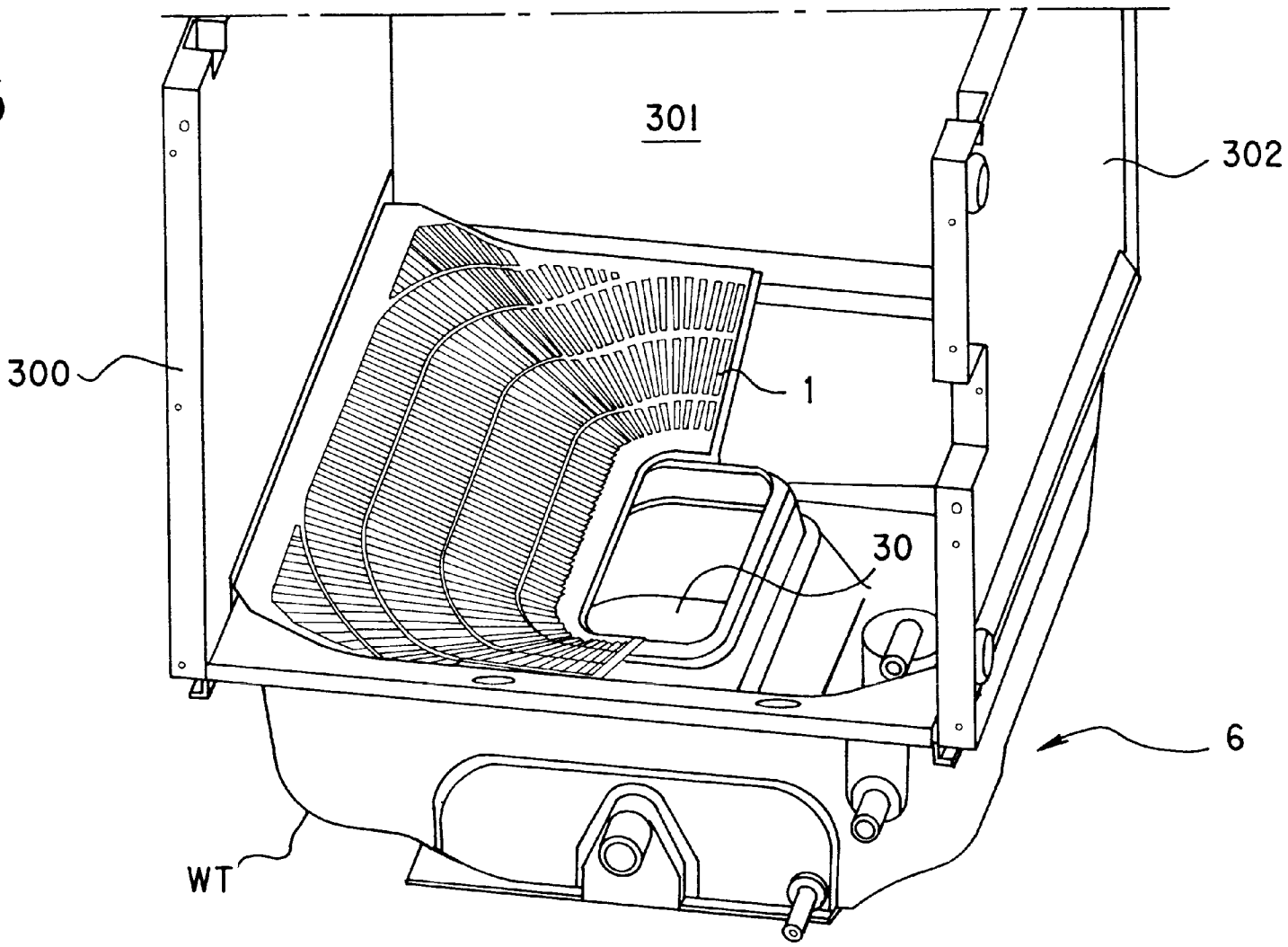
FIG. 5 is a perspective view of FIG. 1 with half of the ice guide snugly fit therein.
Figure 6:
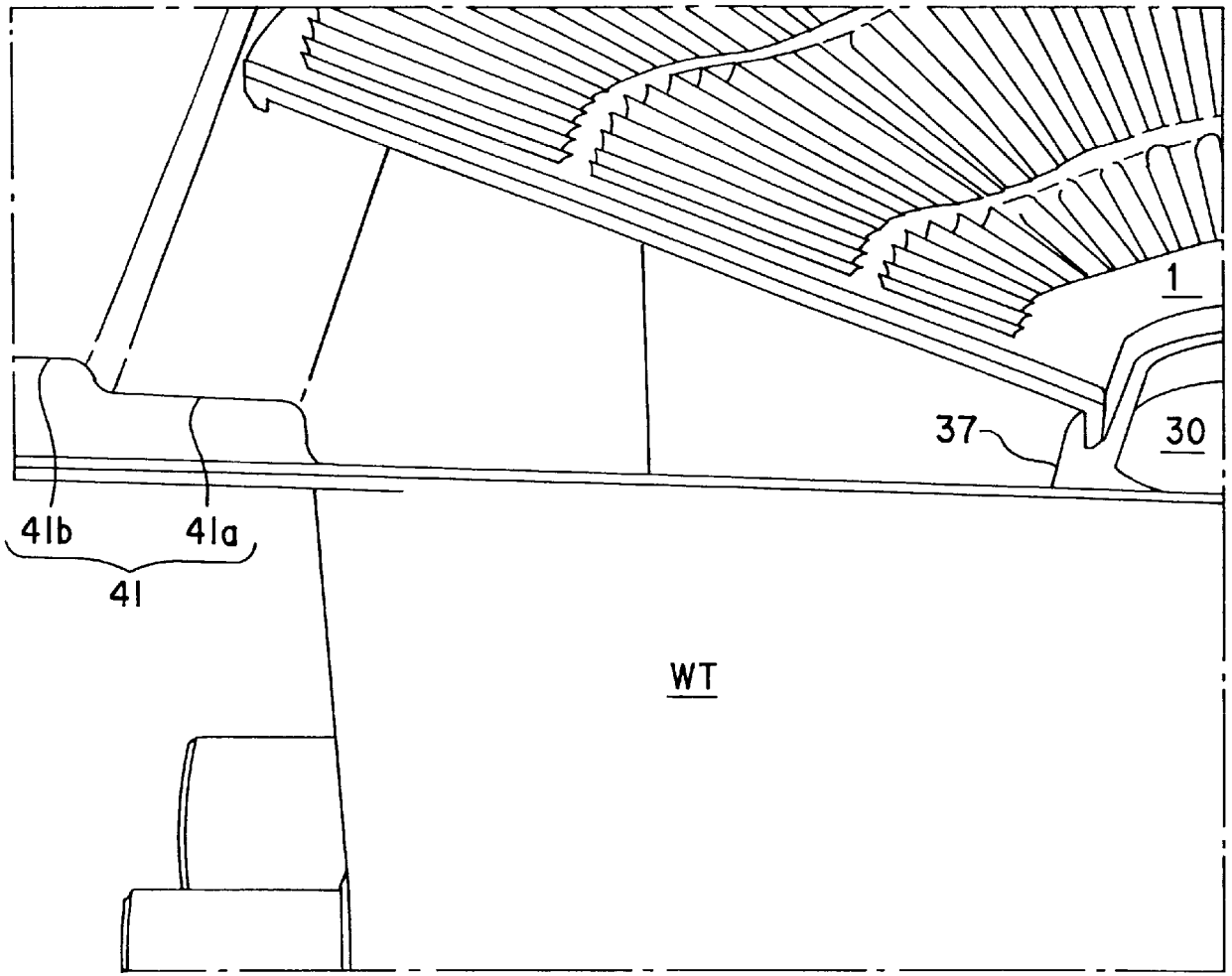
FIG. 6 is a close up of the ice guide snugly fitting within the water tank shown in FIG. 5.

FIG. 5 is a perspective view of the water tank WT surrounded by the walls 300–302 of the ice making machine with half the ice guide 1 to more clearly illustrate the relationship between the water tank WT and ice guide 1. FIG. 6 is a close up of the ice guide 1 snugly fitting within the water tank WT from the direction indicated by arrow 6 in FIG. 5. A front wall of the water tank WT has a funnel edge 41.

The funnel edge 41 includes a step portion 41*a* and a slide portion 41*b*. A slanted lip 37 of the water tank WT defines the rectangular aperture 30 through which the ice I is directed. The ice guide 1 is snugly fit between the transition area of the slide portion 41*b* and step portion 41*a* and the slanted lip 37 of the water tank WT and slopes in a downward direction from the transition area to the slanted lip 37. The end 90 of the ice guide 1 resting on the slanted lip 37 of the water tank WT is directed toward the slanted lip 37 so that any water dripping from the evaporator plates EP or water formed from melted ice will travel along the downward slope of the ice guide 1 and fall between the end 90 of the ice guide 1 and slanted lip 37. Then, the water will be directed to a base of the water tank WT by the slanted lip 37 rather than fall into the ice bin 100 where it would melt the ice I stored therein. The design of the slanted lip 37 also prevents such water from sitting in a single location and stagnating, which would create health hazards as well as an unpleasant odor.

Figure 7:
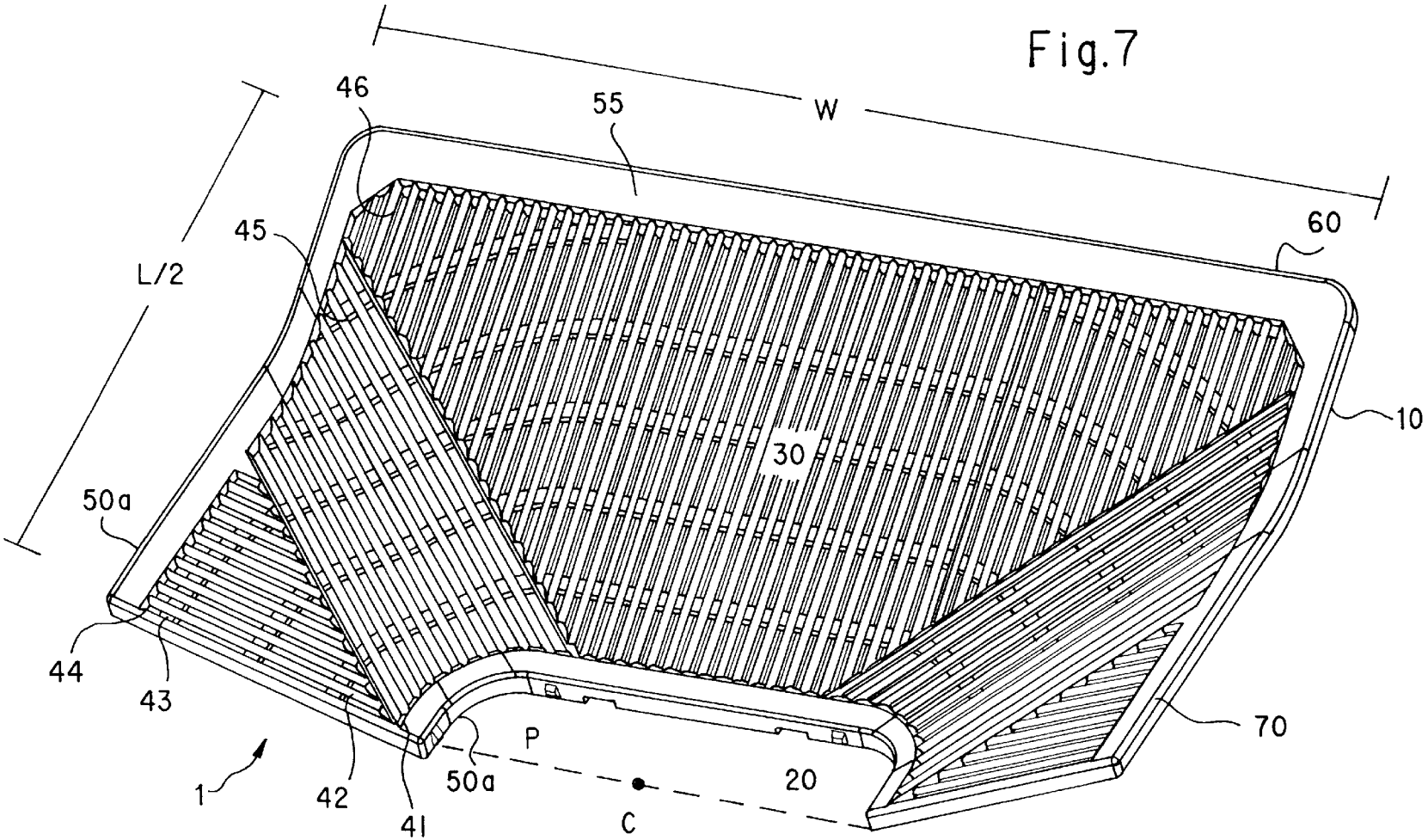
FIG. 7 is a top perspective view of a first component of the ice guide according to a preferred embodiment of the invention.

FIG. 7 illustrates a top perspective view of a first component 10 of the ice guide 1 according to a preferred embodiment. The ice guide 1 is manufactured from any suitable material, such as, for example only, Acrylonitrile Butadiene Styrene (ABS) or other National Sanitation Foundation (NSF) approved plastic that can withstand an injection molding process. The dimensions of the ice guide 1 are such that a width W and length L completely span a top portion of the water tank WT into which the ice guide 1 fits snugly.

Figure 8:
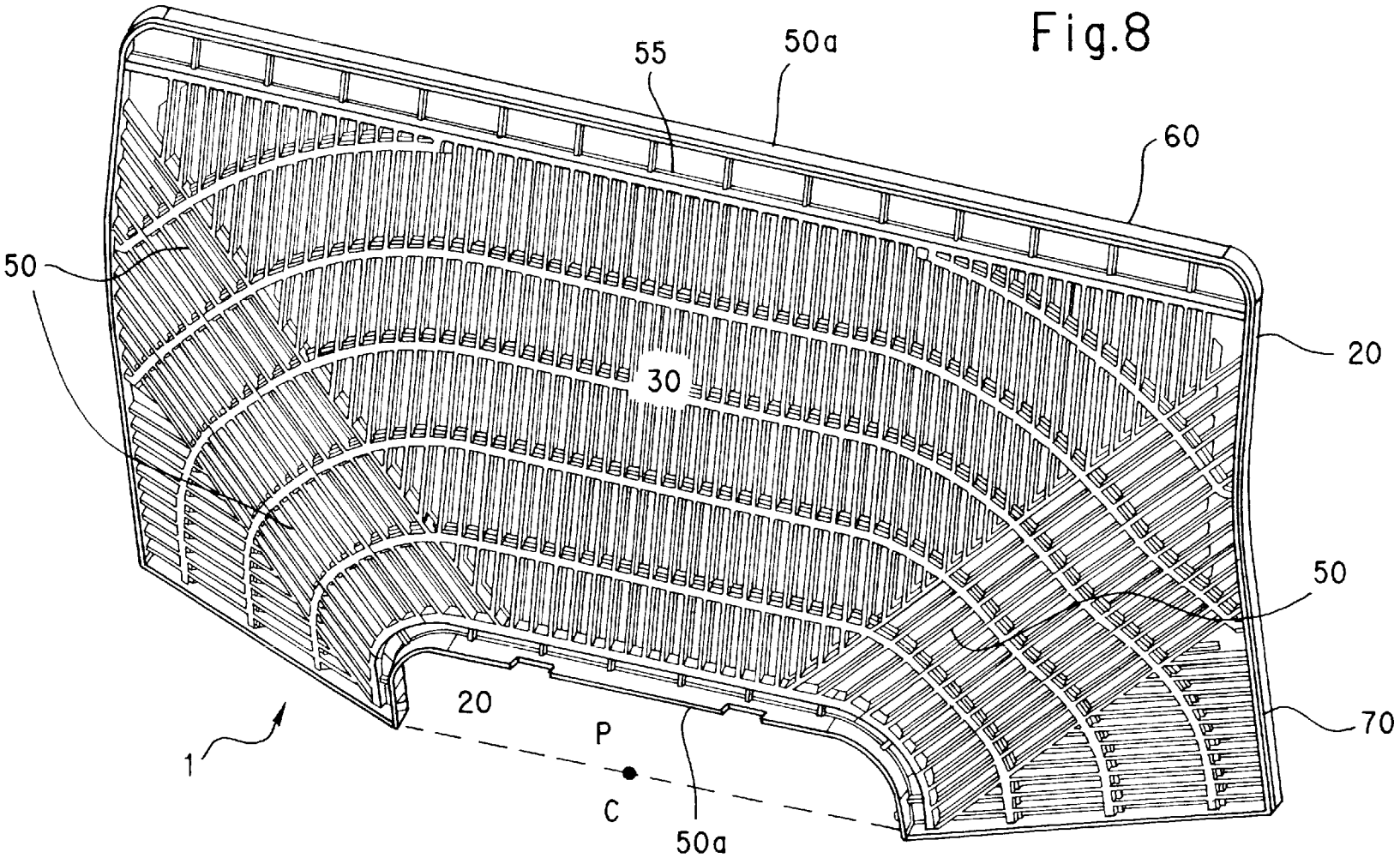
FIG. 8 is a bottom perspective view of a second component of the ice guide that interlocks with the first component illustrated in FIG. 1.

The first component 10 and second component 20 (FIG. 8), when combined (FIG. 9), form a rectangular aperture 20. The formed ice I harvested from the evaporator EP is delivered through the aperture 20 of the ice guide 1 and rectangular aperture 30 of the water tank WT to the ice storage bin 100 below. As shown in FIGS. 7–8, the ice guide 1 includes first and second components 10 and 20, respectively, having a lattice structure 30.

The lattice structure 30 includes a plurality of rows 41–46 of rails 50 that radiate away from the aperture 20. It should be noted that the number of rows 41–46 shown in FIGS. 7–8 is merely for illustrative purposes and should not be construed as limiting the scope of the invention. In fact, it is within the scope of this invention to have as many rows as necessary, so long as the ice guide 1 completely spans the water tank into which the guide is snugly fit.

The rows 41–46 radiate away from a center C of the aperture 20 in an arcuate manner. Furthermore, the rails 50 in the rows 41–46 each have a longitudinal axis 50*a* directed toward the aperture 20. The rails 50 are positioned as such so that any ice dropped onto the ice guide 1 from the evaporator will slide along the axis 50*a* of the rail 50 toward the aperture 20. The rails 50 are separated from each other a predetermined distance to permit drops of water and pieces of ice that breaks off the dropped ice to pass therethorugh.

The first and second components 10 and 20, respectively, each have a first side 60 and a second side 70 positioned at a non-planar altitude higher than a horizontal plane P passing through the center C of the aperture 20. The angled nature of the first and second sides 60 and 70 relative to the plane P provides the ice guide 1 with a slope along which the dropped ice slides before dropping through the aperture 20 into the bin below. Furthermore, the rows 41–46 of rails 50 are bounded by a solid band 55 to provide the ice guide 1 with additional rigidity.

Moreover, the solid band 55 is the portion of the ice guide 1 which snugly fits into indentations or step portions of the water tank. Because the solid bands 55 rest within indentations or step portions, the bands 55 provide a seal that prevents the ice from dropping between the ice guide 1 and side wall of the ice making machine and thereby escaping.

Figure 9:
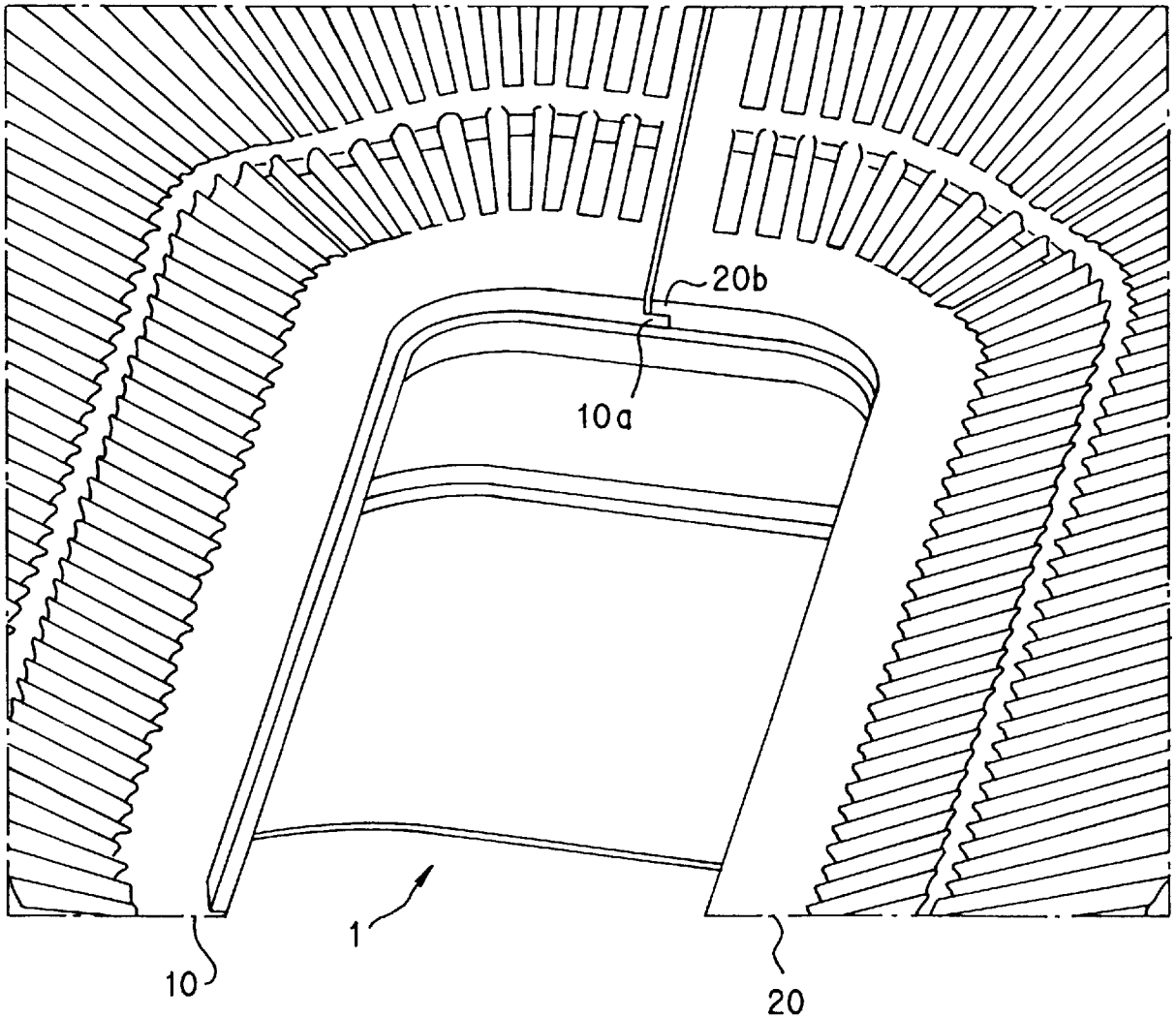
FIG. 9 is a perspective view of the interfitting portions of the first and second components of the ice guide mating.

FIG. 9 shows the first component 10 having ain interfitting mating portion 10*a* that mates with a corresponding interfitting mating portion 20*b* of the second component 20. The mated first and second components 10 and 20 result in a single ice guide 1. It should be noted that the shown locations of the interfitting mating portions 10*a* and 20*b* are merely illustrative and are not meant to limit the scope of this invention. In fact, the male and female portions 10*a* and 20*b* can be positioned along any abutting surfaces of the first an second components 10 and 20 to facilitate the joining of the two components 10 and 20. Furthermore, it should be noted that the ice guide 1 can be designed to include more than two interfitting portions 10a and 20*b,* such as, for an example only, eight, such that if one of the eight was broken by the falling ice 1, only the broken portion would be replaced, thereby making the ice guide according to this invention more cost effective to maintain and repair.

While the invention has been described in conjunction with a specific embodiment thereof, it is evident that many alternatives, modifications and variations may be apparent to those skilled in the art. Accordingly, the specific embodiment of the invention as set forth herein is intended to be illustrative, not limiting. Various changes may be made without departing from the spirit and scope of the invention as set forth in the following claims.

For example, the illustrated embodiment discussed above provides for mating or multi components. It is within the scope of this invention to have an ice guide comprising the first and second components as an integral unit. Likewise, it is also within the scope of this invention to provide multiple interfitting components.

What is claimed is:

1. An ice guide for snugly fitting into a water tank of an ice making section of an ice manufacturing machine, the ice guide comprising:

a lattice structure including a pair of substantially parallel first sides and substantially parallel second sides orthogonal to said first sides, said lattice structure defining an aperture in a center thereof and having a plurality of rows radiating from said center in an arcuate manner, each of said rows including a plurality of spaced rails, each rail having a longitudinal axis directed toward said aperture; and a band bounding said rows, wherein said band at each of said first sides and said second sides is positioned at a non-planar altitude higher relative to a horizontal plane passing through said center.

2. The ice guide according to claim 1, wherein said lattice structure and band are manufactured from either one of Acrylonitrile Butadiene Styrene or other National Sanitation Foundation approved injection moldable plastic material.

3. The ice guide according to claim 1, wherein said lattice structure has a width and length that spans a top portion of the water tank.

4. The ice guide according to claim 1, wherein said lattice structure further comprises first and second components.

* * * * *